United States Patent [19]

Larson

[11] 4,379,349

[45] Apr. 12, 1983

[54] SUN-OUT FACE SHIELD

[76] Inventor: Betty D. Larson, 3915 Lupe, Chino, Calif. 91710

[21] Appl. No.: 211,081

[22] Filed: Nov. 28, 1980

[51] Int. Cl.[3] ..... A42B 1/18; A45C 3/00

[52] U.S. Cl. ..... 2/9; 2/177; 2/209.1

[58] Field of Search ..... 2/209.1, 177, 9, 196; 150/1.7, 0.5, 48, 50; 224/187, 218; 220/94 R, 95; 135/5 R, 7.1 R

[56] References Cited

U.S. PATENT DOCUMENTS

| | | | |
|---|---|---|---|
| 2,558,995 | 7/1951 | Tullis | 150/1.7 X |
| 3,651,847 | 3/1972 | Casamassima | 2/177 X |
| 4,180,112 | 12/1979 | Bovet | 150/1.7 |

FOREIGN PATENT DOCUMENTS

| | | | |
|---|---|---|---|
| 2736289 | 2/1979 | Fed. Rep. of Germany | 150/1.7 |

*Primary Examiner*—Peter P. Nerbun
*Attorney, Agent, or Firm*—Robert K. Wallor

[57] ABSTRACT

This invention presents a face shield for beach or sunbathing use. The face shield is formed of a rigid transparent material, containing pigmenting or surface films to block the transmission of damaging ultraviolet rays from the sun. In cross-section, this material is formed into an arc. From each end of the arc, simple support legs are provided such that the face shield will rest on the earth surface with room for motion of the user's head beneath the shield. Air circulation is enhanced by such support and by ventilation holes in the face shield near the support legs. The support legs are foldable toward the concave center of the face shield, and are useful as carrying handles for the face shield in an inverted position. When carried in such manner, the face shield can be used to serve as a "tote" for towels and other beach paraphernalia.

7 Claims, 6 Drawing Figures

SUN-OUT FACE SHIELD

BACKGROUND OF THE INVENTION

A variety of sun shields and windscreens for personal use are to be found within the existing art. This inventor's search has identified the following United States Patents as being most closely related to the present invention: U.S. Pat. No. 2,193,469 (Ashton); U.S. Pat. No. 2,832,360 (Juhase); U.S. Pat. No. 4,030,747 (Brock); U.S. Pat. No. 4,063,318 (Nicholson); U.S. Pat. No. 4,098,281 (Bonfilio); and U.S. Pat. No. 4,180,112 (Bovet). Each of these inventions has the same broad general purpose of shielding the user's face or person from sun and/or wind. Some have flexible form configuration. Others are attached to or are part of lawn or beach furniture. Still others are self-supporting and collapsible, however, many have complexities not found in the present invention.

The use of the present invention stems from the experiences of persons who enjoy sunbathing. In order to expose their frontal portions of their person, they must lie such that they are facing the sun. The incidence of direct sun upon their faces, in many instances, causes discomfort to the eyes, and the potential for severe burns to the sensitive areas of the head and face.

Many approaches to this problem are in common usage, ranging from a towel over the face to beach umbrellas. The towel approach presents discomforts in that it rests directly on the user's face and does not provide much air circulation. The beach umbrella approach requires the user to periodically move the umbrella to reposition the shade to a desired location.

The present invention improves upon these approaches, and those of the cited Patents by being simple, portable, collapsible and by offering the further features of air circulation, visibility of and to the user, and in serving as a hand carrier for towels and the like when not in use as a face shield.

The invention herein disclosed is further envisioned to have alternate embodiments, each of which provide the advantages herein claimed.

SUMMARY OF THE INVENTION

The present invention provides a sunbather with both a hand carrier for his or her towels and the like and a facial sun shield having room for head motion and providing visibility and air circulation.

The face shield is constructed of a generally rectangular sheet of rigid transparent material which contains a pigmentation, or additive, or surface films such that harmful sun's rays are not transmitted through said sheet. The sheet is formed or molded into an arch configuration such that the radii of curvature originate and are normal to an axis parallel to the shorter dimension of the rectangle.

Depending from each end of the arched sheet is a leg member, formed of a heavy gauge wire or similar material, and configured to form a broad "U"-shape, with the base of the "U"-shape extending essentially the full distance of the shorter dimension of the sheet. The upper ends of the upright extensions of the "U"-shape leg member are rotatably attached to the face shield sheet member such that they are free to rotate about the point of attachment toward the axis of curvature of the arched sheet, but such that they are not free to rotate in the opposite direction beyond the tangent to the concave inner surface of the arched sheet.

The arched sheet, in a first alternate embodiment, contains a plurality of air circulation holes uniformly distributed near the lower ends of the arched sheet.

As a second alternate embodiment, the points of attachment to which the "U"-shaped leg members are rotatably attached, are configured such that the leg members may be removed and relocated into further points of attachment so that the vertical clearance within the concave region within the arched sheet may be moderately varied.

As a further alternate embodiment, the arched sheet member may contain a decorative design for aesthetic appearance.

In all embodiments, the vertical extent of the "U"-shaped leg members is such that when they are both rotated equally toward the axis of curvature of the arched sheet, they will meet and form a carrying handle for the inverted arch to serve as a carrier or tote.

DESCRIPTION OF THE INVENTION

Figure 1:
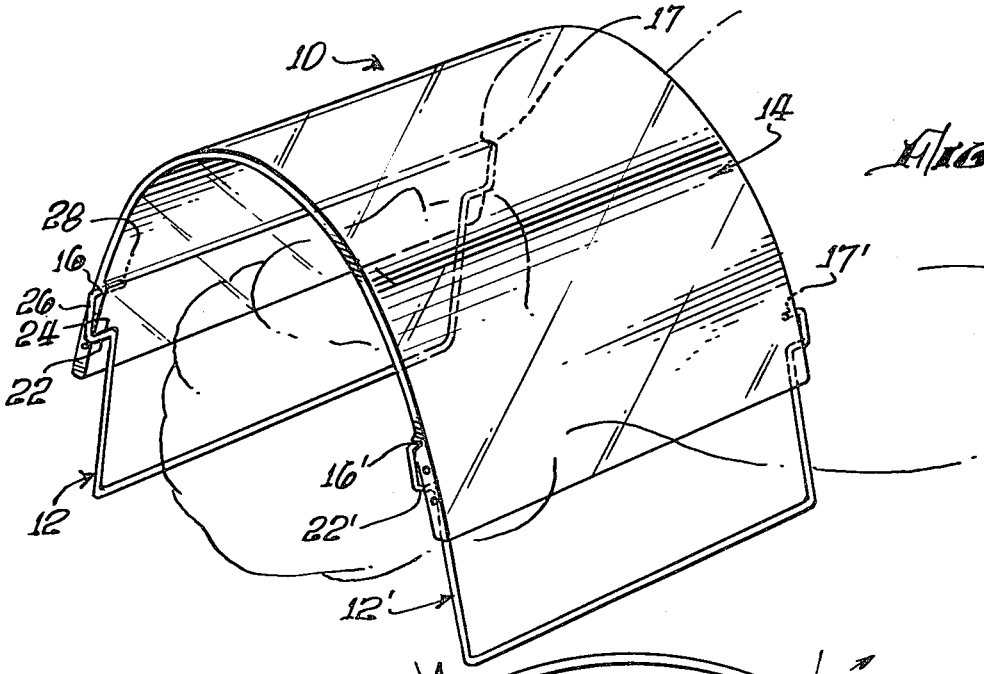
FIG. 1 illustrates, in perspective view, the "Sun-Out Face Shield" placed over the head and face of a user.

With continuing reference to the drawings, FIG. 1 presents a perspective view of the present invention as in use. The face shield 10 is shown resting on the surface of the earth or beach, with its generally "U"-shaped leg members 12, 12' fully deployed, and supporting a transparent sheet member 14, formed into an arch, concave downward. Illustrated, to show the use, is a ghost image of a user, showing the room available for motion of the user's head.

Figure 2:
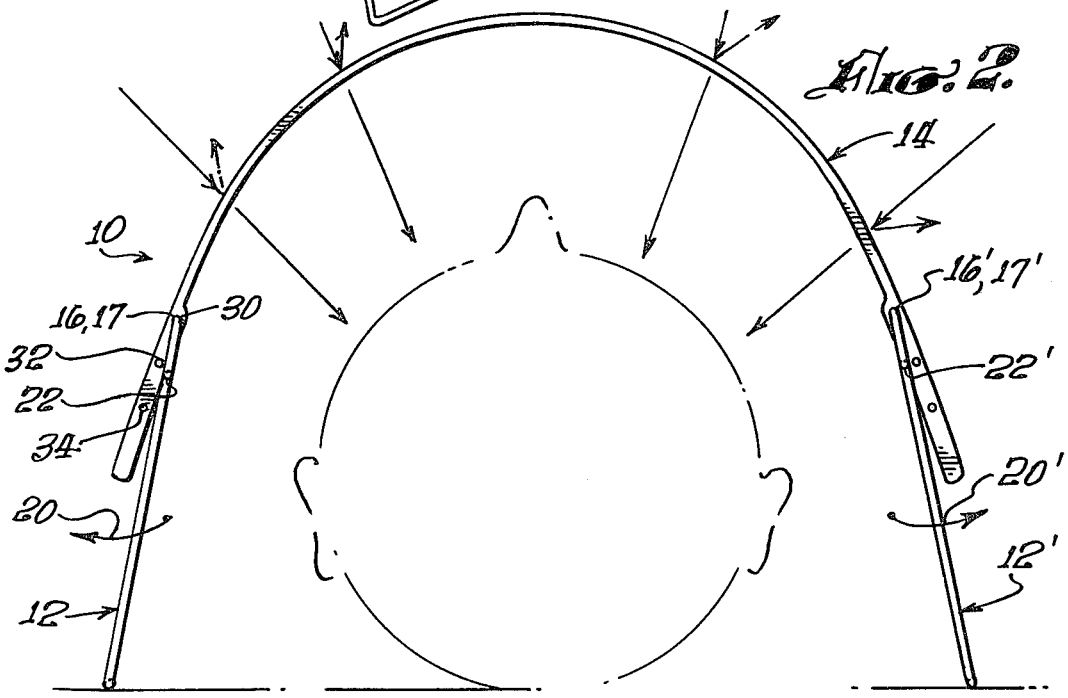
FIG. 2 presents an elevation view of the invention in use.

Referring now to FIG. 2, the face shield 10 is shown in elevation view looking toward the top of the head of a user (reference). The arched shape of the sheet member 14 is clearly illustrated. For reference, arrows are shown to illustrate sun's rays passing through the arched sheet 14, as at various times of the day. Depending from each end of the arched sheet 14 are leg members 12, 12' which, in turn, rest on the reference surface. Said leg members 12, 12' are each configured in a generally "U"-shape more clearly shown in FIG. 1 and FIG. 6. Said leg members 12, 12' are rotatably attached to said arched sheet member 14 at points of attachment 16, 16', 17, 17', such that the leg members 12, 12' may rotate about axes normal to the plane of FIG. 2 through said points of attachment 16, 16', 17, 17', one such axis passing through points 16 and 17 and the other such axis passing through points 16' and 17'. For each leg member 12, 12', its rotation in a direction away from the other leg member, in the directions of reference arrows 20, 20', is limited to the extent where the upright extensions of the "U"-shaped leg members 12, 12' come into contact with the lower extensions of the arched sheet member 14 at points 22, 22'. In the preferred embodiment, only one set of points of attachment are envisioned.

Figure 3:
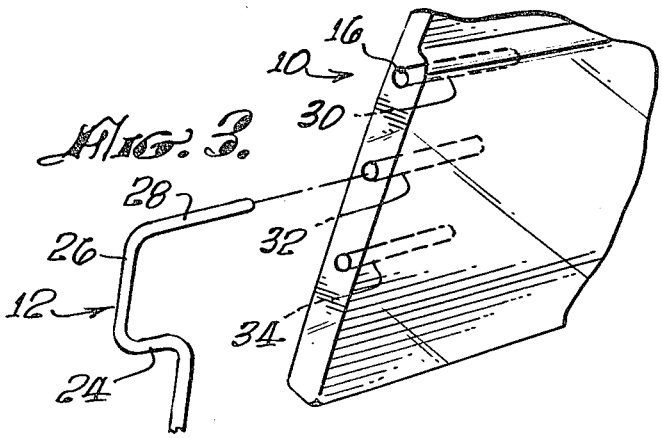
FIG. 3 depicts the preferred method of attachment of the leg members to the arched sheet member.

Referring now to FIG. 3, a partial exploded view of the method of attachment of leg member 12 to the arched sheet member 14 is illustrated, and is typical of all such attachments. The upper extremity of leg 12 is seen to have a series of bends forming segments 24, 26, and 28, all such segments being co-planar with the balance of leg member 12. The most extreme of such segments, segment 28 is then parallel to the base of the "U"-shape of leg member 12. Said segment 28 serves as the axis of rotation through the point of attachment 16. Formed or machined into the arched sheet member 14 is a hole 30 which accepts segment 28 when assembled.

In alternate embodiments of the present invention, the arched sheet member 14 may contain a series of holes 30, 32, 34 providing moderate variability in the maximum elevation of the apex of the face shield 10 above the referenced supporting surface.

In all such embodiments, the length of segment 26 of the leg member 12 is such that segment 24 will make contact with the arched sheet member 14, precluding further rotation away from the axis of curvature while permitting such rotation to approximate the tangent to the inner surface of the arched sheet member 14.

Figure 4:
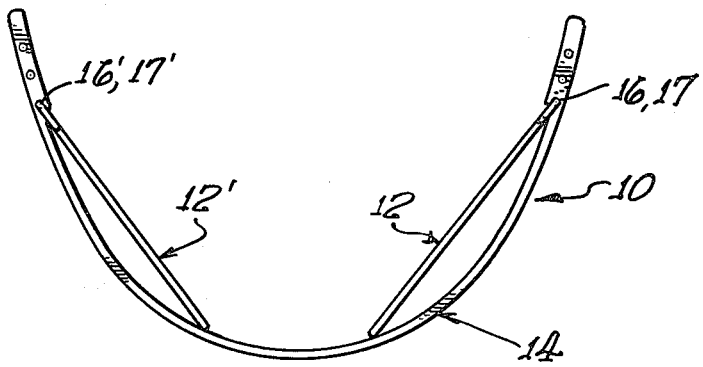
FIG. 4 illustrates the "Sun-Out Face Shield" in its storing condition.

Referring now to FIG. 4, the leg members 12, 12' are shown fully rotated to rest within the concave region of the arched sheet member 14 for storage purposes.

Figure 5:
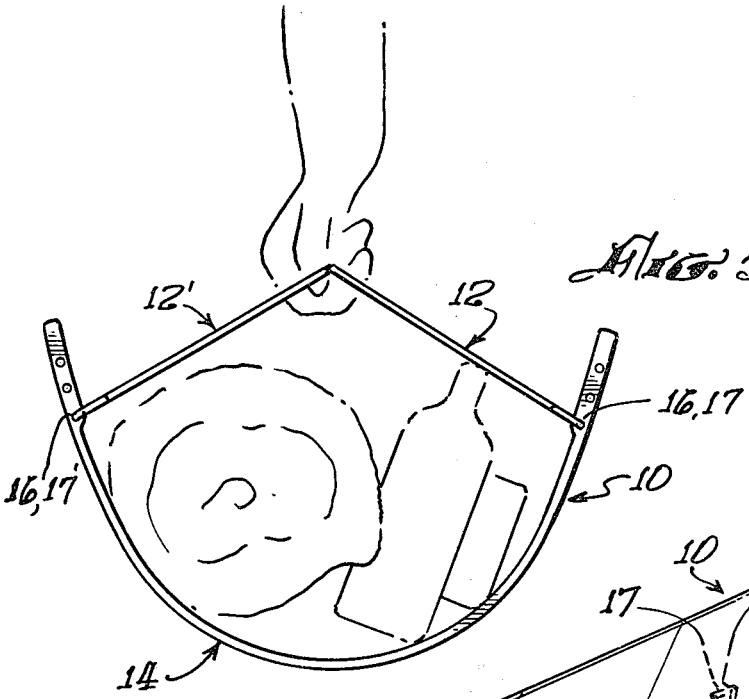
FIG. 5 illustrates the "Sun-Out Face Shield" in use as a carrier or tote.
Figure 6:
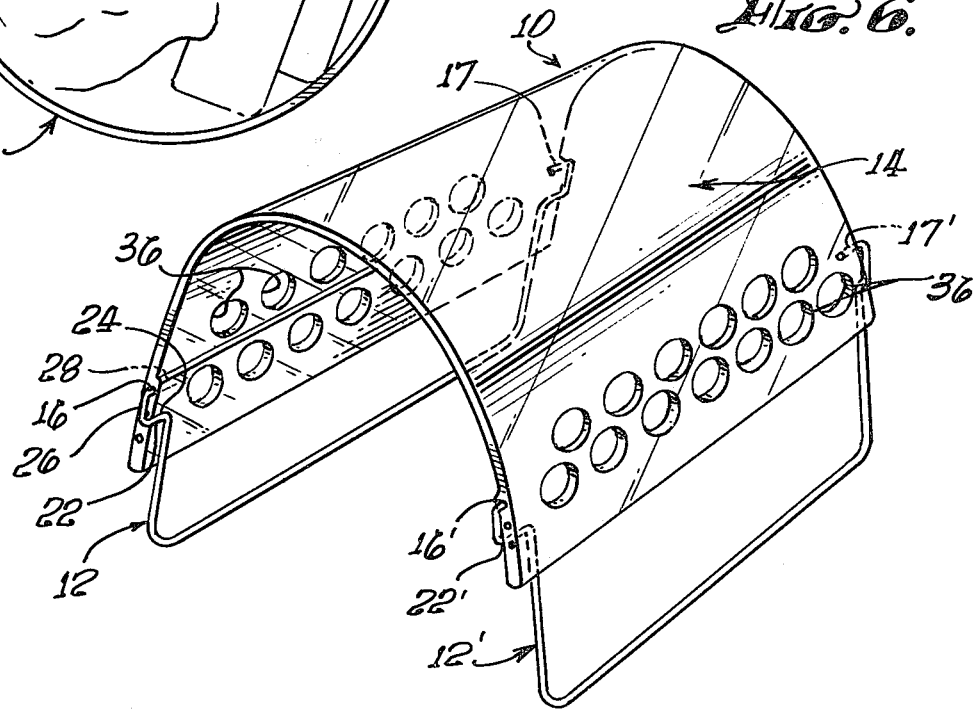
FIG. 6 presents an alternate embodiment of the "Sun-Out Face Shield", containing air circulation holes.

Referring now to FIG. 5, when the leg members 12, 12' are partially rotated equally from their face shield rest position shown in FIGS. 1, 2 and 6, they come into close proximity with each other so that they may be used as carrying handles for the inverted arched sheet member 14. In such configuration, the arched sheet member 14 serves as a receptacle for carrying towels and the like to and from the beach or other sunbathing area.

Referring now to FIG. 6, a further alternate embodiment is illustrated showing a plurality of air circulation holes 36 located in the lower extremities of the arched sheet member 14. Said holes 36 provide for added air circulation within the area beneath the concave arch of the face shield 10.

Referring again to the several drawings taken together, the arched sheet member 14 is formed or molded of a transparent material having sufficient rigidity to maintain the designed shape. Said material either contains an additive or is otherwise treated with one of a standard variety of additives or coatings that block the transmission through the face shield 10 of the sun's harmful rays, yet enable the user to look out through said face shield 10 with only marginally reduced visibility.

While the present invention as herein described and illustrated provides specific details of a preferred and selected alternative embodiments, the inventor envisions additional embodiments of the invention that require no further inventive capacity by a person skilled in the art to which the invention pertains, all of which are intended to be included within the scope of the appended claims.

By these presents,

I claim:

1. A face shield to cover a sunbather's head and face comprising a sheet member of transparent, ultraviolet blocking material formed into a cylindrical or hyperbolic arch resting upon a pair of generally "U"-shaped leg members which are respectively rotatably attached to each one of the lower end regions of said arched sheet member, said leg members, when used to support said arched sheet member, being blocked by contact with said arched sheet member from rotations respectively outward from the concave region beneath said arched sheet member, and said leg members, when equally rotated toward the plane bisecting the concave region in a direction parallel to the axis of revolution of the arched sheet member, come into close proximity with each other to serve as carrying handles for the face shield when inverted to form a tote.

2. The face shield of claim 1, wherein a plurality of points of rotatable attachment are provided for each leg member.

3. The face shield of claim 1, wherein the lower extremities of the arched sheet member contain a plurality of decorative holes which further serve to increase air circulation within the concave region beneath the arched sheet member.

4. The face shield of claim 1, wherein a decorative design is fabricated upon the surface of the arched sheet member.

5. The face shield of claim 2, wherein the lower extremities of the arched sheet member contain a plurality of decorative holes which further serve to increase air circulation within the concave region beneath the arched sheet member.

6. The face shield of claim 2, wherein a decorative design is fabricated upon the surface of the arched sheet member.

7. The face shield of claim 3, wherein a decorative design is fabricated upon the surface of the arched sheet member.

* * * * *